US006575513B2

(12) United States Patent
Pikel

(10) Patent No.: US 6,575,513 B2
(45) Date of Patent: Jun. 10, 2003

(54) SHAFTED SPORTS EQUIPMENT CARRIER

(76) Inventor: Jeffrey J. Pikel, 808 E. Gump Rd., Fort Wayne, IN (US) 46845

( * ) Notice: Subject to any disclaimer, the term of this patent is extended or adjusted under 35 U.S.C. 154(b) by 0 days.

(21) Appl. No.: 09/916,409

(22) Filed: Jul. 27, 2001

(65) Prior Publication Data

US 2003/0020295 A1 Jan. 30, 2003

(51) Int. Cl.[7] ..... A45F 5/00; B66D 71/00

(52) U.S. Cl. ..... 294/159; 294/166; 294/170

(58) Field of Search ..... 294/137, 145–148, 294/159, 162, 163, 165, 166, 170, 160; 206/315.2, 315.11, 443; 211/60.1, 70.2, 70.5, 70.8; 224/916, 917, 922; 280/814

(56) References Cited

U.S. PATENT DOCUMENTS

| | | | | |
|---|---|---|---|---|
| 1,679,183 A | * | 7/1928 | Sidon | 294/166 |
| 2,816,696 A | | 12/1957 | Stockfleth | 294/143 |
| 3,232,503 A | * | 2/1966 | Thonen | 294/162 X |
| 3,591,063 A | | 7/1971 | Pearce | 294/137 |
| 3,626,553 A | | 12/1971 | Darney et al. | 280/214 |
| 3,880,336 A | | 4/1975 | Demasson | 294/165 |
| 4,059,209 A | | 11/1977 | Grisel | 294/147 |
| 4,134,182 A | | 1/1979 | Ramsby | 294/147 |
| 4,190,182 A | | 2/1980 | Hickey | 294/147 |
| 4,193,495 A | | 3/1980 | Keeley | 294/143 |
| 4,331,357 A | | 5/1982 | Contreras | 294/145 |
| 4,699,415 A | | 10/1987 | Skovajsa | 294/147 |
| 4,871,102 A | | 10/1989 | Wickersham | 224/191 |
| 5,154,467 A | | 10/1992 | Lanius et al. | 294/160 |
| D338,048 S | | 8/1993 | Finley | D21/796 |
| 5,249,723 A | | 10/1993 | Lamadelein | 224/257 |
| 5,899,514 A | | 5/1999 | York et al. | 294/163 |
| 5,954,379 A | | 9/1999 | Pikel | 294/159 |

FOREIGN PATENT DOCUMENTS

| | | | | |
|---|---|---|---|---|
| DE | 79775 | * | 5/1894 | 294/166 |

* cited by examiner

*Primary Examiner*—Eileen D. Lillis
*Assistant Examiner*—Paul T. Chin
(74) *Attorney, Agent, or Firm*—Susan L. Firestone; Paul W. O'Malley

(57) ABSTRACT

The invention relates to a carrier for sports equipment having a shaft. The carrier has a base with curved shaftholders at opposite ends and a handle. The shaftholders hold the shaft in place to allow the sports player to carry the shafted equipment for long distances and alter the carrier's position while reducing stress on the wrist.

4 Claims, 3 Drawing Sheets

SHAFTED SPORTS EQUIPMENT CARRIER

BACKGROUND OF THE INVENTION

1. Field of the Invention

The present invention relates to improvements in a carrier for long, shafted sports equipment and more particularly to a hand held carrier.

2. Description of the Prior Art

Long, shafted, sports equipment is awkward to carry. Ice hockey sticks, for example, are typically more than four feet long. Because hockey sticks can break or crack during use, players often carry at least two sticks.

It is fatiguing and uncomfortable to carry long shafted equipment vertically or unbalanced for long distances, such as from a car in a parking lot to an arena or playing field. Carrying long shafted equipment, such as hockey sticks, vertically or unbalanced locks the wrist in a flexed position, which over time is fatiguing and uncomfortable. If the player grasps the sticks away from their center of gravity, the unbalanced sticks flex the wrist away from a neutral.position. Furthermore, the sticks' center of gravity concentrates the weight on the flexed wrist which additionally stresses the wrist.

Carrying hockey sticks horizontally stresses the wrist less. When carrying the sticks horizontally, however, they jut out several feet in front and behind the player. In order to open doors and walk through doorways or narrow corridors to the locker room, the player must tip the sticks vertically. Similarly if the doorway or corridor is crowded, the user must tip the sticks to avoid striking others.

The holder shown in FIG. 7, for example, allows the stick to be carried horizontally. The design of the locking portion, however, allows only one stick to be carried.

Players usually carry more than just sports sticks. Players must carry the sticks and all of the requisite gear associated with their particular sport. The player's gear usually comprises bulky additional equipment, such as protective padding, uniforms, skates or shoes, helmets, pucks or balls, and the like. In colder weather, the player may also struggle with heavy winter clothing, boots and gloves. The player carries all of this gear from the parking lot into the ice arena and to the locker room, often over long distances and in one trip.

An additional problem is designing a carrier for a player to easily insert and remove one or more shafted stick. Carriers with long locking portions are cumbersome when inserting and removing the shaft of the stick. The sidewalls of the carrier must be forced apart to insert the shaft, often requiring both hands to lock the stick into place. Because more of the shaft is locked into the carrier, the shaft will not release as readily from the carrier, again requiring the use of two hands to force apart the sidewalls. These steps become more difficult in colder weather, when hands are cold and stiff and possibly gloved.

Carriers using only a single short locking portion have other problems. While the shaft is easier to insert and remove in the short locking portion, less shaft locks within the carrier. The shafted stick is therefore more prone to being off balance while being carried, unless the user evenly distributes the weight of the stick. Additionally, if the stick catches on something, the stick can easily pop out of the carrier.

U.S. Pat. No. 5,954,379 issued to the inventor Jeffrey A. Pikel and incorporated in its entirety herein by reference, discloses a carrier for shafted sports equipment that solves many of these problems. The carrier uses two shaftholders to lock the stick firmly in place. Yet, the design easily allows the user to remove the sticks from the shaftholders, even with gloved hands. The shaftholder of the carrier also accommodates shafts with minor differences in their widths, generally ranging up to about 0.1 in.

Shafted sticks, however, come in a large variety of widths and heights. Children's hockey sticks, for example, have narrower widths than adult hockey sticks, the difference being greater than about 0.1 in. Therefore, a child must use a different carrier than an adult. To accommodate these different widths, a variety of carriers must be made which increases costs in both manufacturing and inventory.

Carrying hockey sticks horizontally, with the wrist hanging unflexed from the arm, aids comfort, provided the sticks do not slide apart or become crossed. It would be advantageous for a carrier to firmly position one or more sticks, and to allow the quick, positive movement of the sticks to a vertical position to fit through tight spaces and avoid hitting others. To meet these and other objectives, it is one object of the invention to provide a lightweight handheld carrier into which a player can easily insert a shaft in such a way that the stick is easily balanced in the carrier upon insertion to reduce stress on the wrist. It is another object of the invention to provide a carrier in which the shafts, or the hand, may be readily repositioned to maintain the sticks in balance to reduce the stress on the wrist. It is still another object of the invention to provide a carrier from which the shafts may be readily extracted. It is a still further object of the invention to provide a carrier which may be readily moved to reposition the shafts to a vertical or other desired orientation. It is another object of the invention to provide a carrier that can accept a wide range of shaft widths.

SUMMARY OF THE INVENTION

The carrier of the invention is for sports equipment with a shaft. The carrier has a base having opposite ends with first and second shaftholders on a face of the base. The shaftholders are aligned to jointly engage the shaft Each shaftholder has an inner sidewall between a pair of outer sidewalls. The outer sidewalls form the sides and curve proximally from the base and have a shoulder, a first portion curving from the base away from the inner sidewall and a second portion curving from the first portion toward the inner sidewall. The shoulders are outwardly angled and extend along the length of the outer sidewall distal to the base. A handle depends from the base and extends from a second face of the carrier opposite the face from which the shaftholders extend.

Other embodiments of the carrier of the invention include ears projecting from opposite sides of the inner sidewall toward the outer sidewalls and extending along the length of the shaftholder. This embodiment can also include ribs depending from the base along the length of the shaftholder and located between the outer and inner sidewalls.

Additional effects, features and advantages will be apparent in the written description that follows.

DETAILED DESCRIPTION OF THE INVENTION

Figure 1:
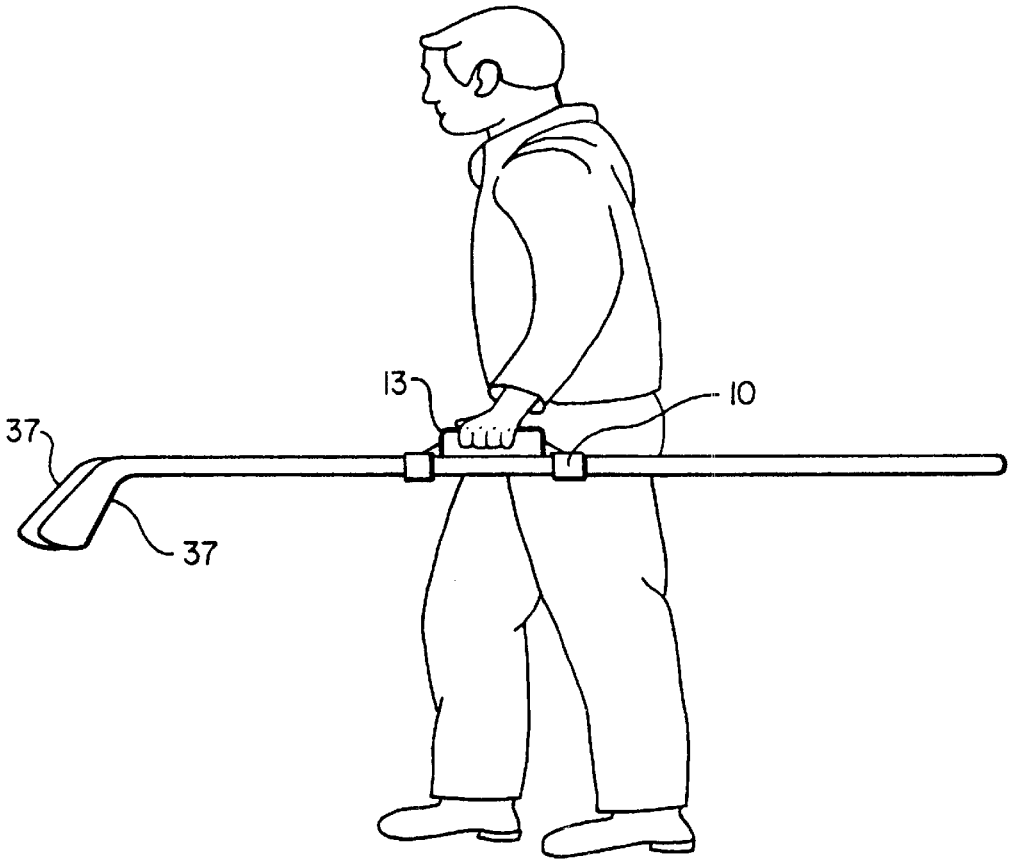
FIG. 1 is a perspective view of the carrier of the invention in use.
Figure 2:
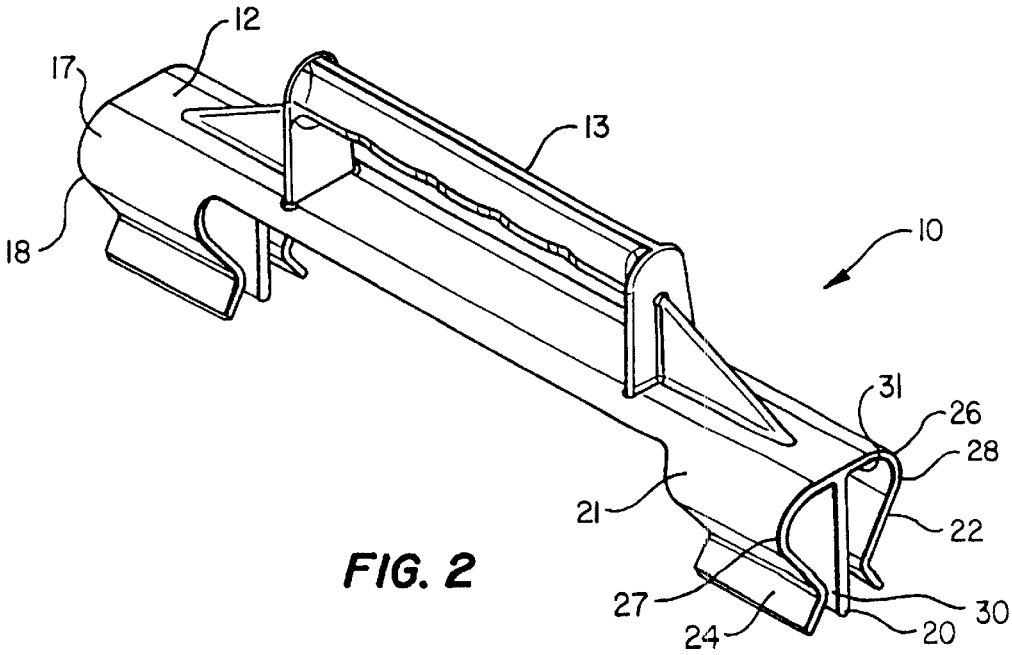
FIG. 2 is a perspective view of one embodiment of the carrier of the invention.

Referring now to the drawings where like reference numerals refer to like features, FIG. 1 depicts an ice hockey player carrying carrier 10 in which are positioned two ice hockey sticks 37. The player grasps handle 13 of carrier 10 with the wrist in a relaxed, unflexed position relative to a relaxed, downwardly directed arm. With the hand and wrist so positioned, hockey sticks 37 lie in a horizontal position. Hockey sticks 37 readily balance between two points of support (described below) on carrier 10 and/or by the player shifting his hand position on handle 13. Carrier 10 firmly retains hockey sticks 37, allowing the player quickly to move the sticks from a horizontal orientation to a vertical orientation without losing control of one of the sticks, having the sticks cross, or other difficulty encountered if the sticks were held directly.

Referring to the Figures, carrier 10 of the invention has a base 12, a handle 13 extending from the top of base 12 and shaftholders 17 extending from the bottom of base 12 and spaced apart at opposite ends 14, 15. Base 12 can be planar or slightly curved. The carrier of the invention holds sports equipment with a shaft, preferably a shaft that has at least one flat face such as a rectangular shaft.

Shaftholders 17 have outer sidewalls 18 and inner sidewall 20, located between outer sidewalls 18. Each sidewall extends outwardly from shaftholder base 31 which may be part of base 12 or separately attached to base 12. Shaft 36 inserts between outer sidewall 18 and inner sidewall 20 of both shaftholders 17. By providing separated shaftholders 17 for engaging a shaft at opposite ends 14, 15 of base 12, carrier 10 insures that an inserted shaft has at least two, spaced apart points of support. The player can easily position a shafted stick in carrier 10 by sight so that the center of gravity of the stick is between the points of support. In the embodiment shown in FIG. 4, the shaft may rest flush against the shaftholder base.

As shown in FIGS. 2–6, outer sidewall 18 has curved section 38 and shoulder 24. Outwardly angled shoulders 24 extend the length of shaftholder 17 distal to shaftholder base 31. Angled shoulders 24 slope away from inner sidewall 20 distal to shaftholder base 31, preferably at an angle θ ranging from about 100° to about 150°, preferably from about 105° to about 135°, more preferably from about 105° to about 130°.

Curved section 38 curves proximally from shaftholder base 31 toward shoulders 24. Curved section 38 has first 26 and second 27 curved portions. First portion 26 curves outwardly or away from inner sidewall 20 to a maximum curvature 28. Second portion 27 curves from the maximum curvature 28 toward inner sidewall 20. Third portion 29 of curved section 38 is located between second portion 27 and shoulder 24 and is preferably linear or straight.

Shoulders 24 of outer sidewall 18 and inner sidewall 20 form restricted opening 30, which is narrower than the shaft's width. Inner shoulder face 32 guides shaft 36 into shaftholder 17 with minimum force through opening 30.

Figure 4:
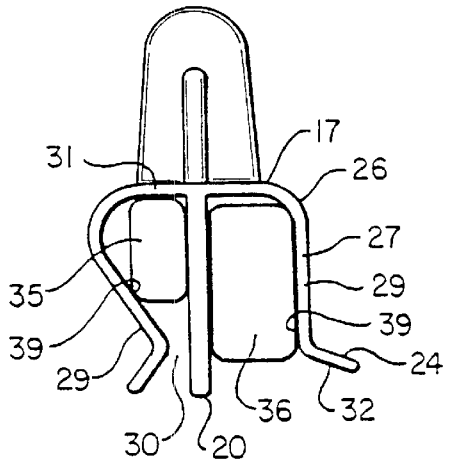
FIG. 4 is a side plan view of one embodiment of the carrier of the invention holding two shafts.

FIG. 4 shows shafts 35, 36 in the carrier. For illustrative purposes, shaft 36 is larger than shaft 35. Outer sidewalls 18 deflect outwardly from inner sidewall 20 and inner sidewall 20 is substantially perpendicular to shaftholder base 31. For shaft 36, outer sidewall 18 touches at least a portion of outer face 39 and holds shaft 36 against inner sidewall 20. Second portion 27 and third portion 29 deflect outwardly toward the maximum curvature. Both second portion 27 and third portion 29 frictionally engage at least part of shaft 36 to hold the shaft within the shaftholder. For a wider shaft in the carrier, outer sidewall 18 deflects farther away from inner sidewall 20.

With smaller shaft 35, outer sidewall 18 deflects away from inner sidewall 20 with only third portion 29 touching part of smaller shaft 35 to maintain frictional contact and prevent shaft 35 from shifting within the holder. A narrower and shorter shaft might only have second portion 27 of sidewall 18 frictionally engaging the shaft. The outward angle that outer sidewall 18 assumes under pressure from the shaft, especially shaft 36, makes it easier to remove the shaft from the carrier without losing the frictional contact that prevents the shaft from falling from the carrier when carried by a player.

Figure 5:
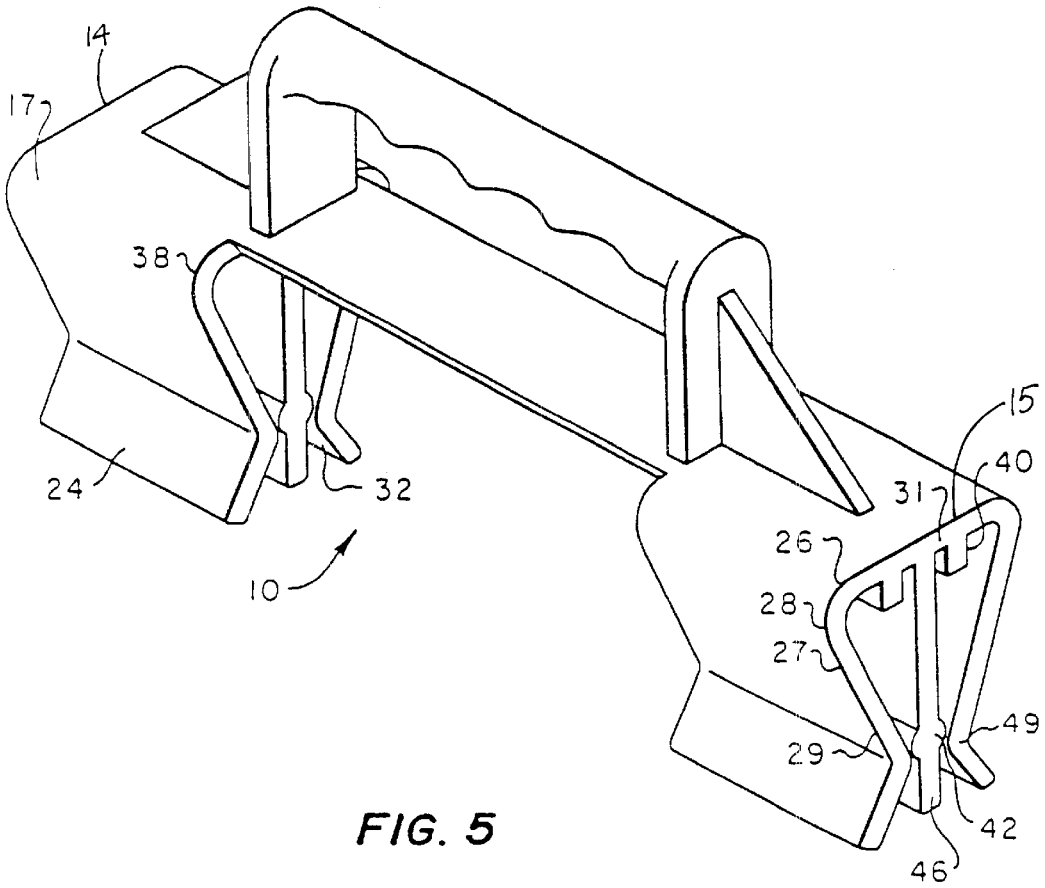
FIG. 5 is a perspective view from the side of another embodiment of the carrier of the invention.
Figure 6:
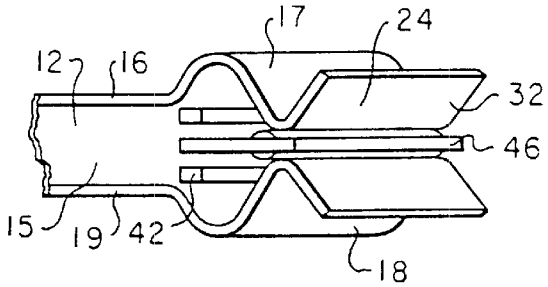
FIG. 6 is a partial bottom plan view of a shaftholder of the embodiment of FIG. 5.
Figure 7:
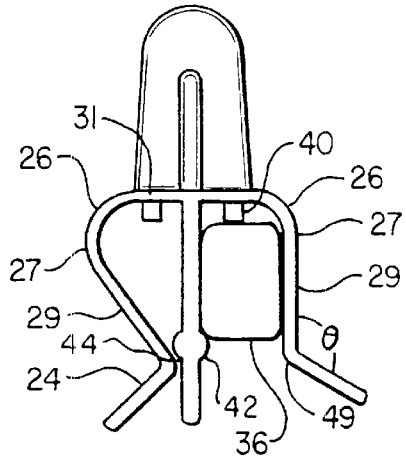
FIG. 7 is a side plan view of the embodiment of FIG. 5 holding one shaft.
Figure 8:
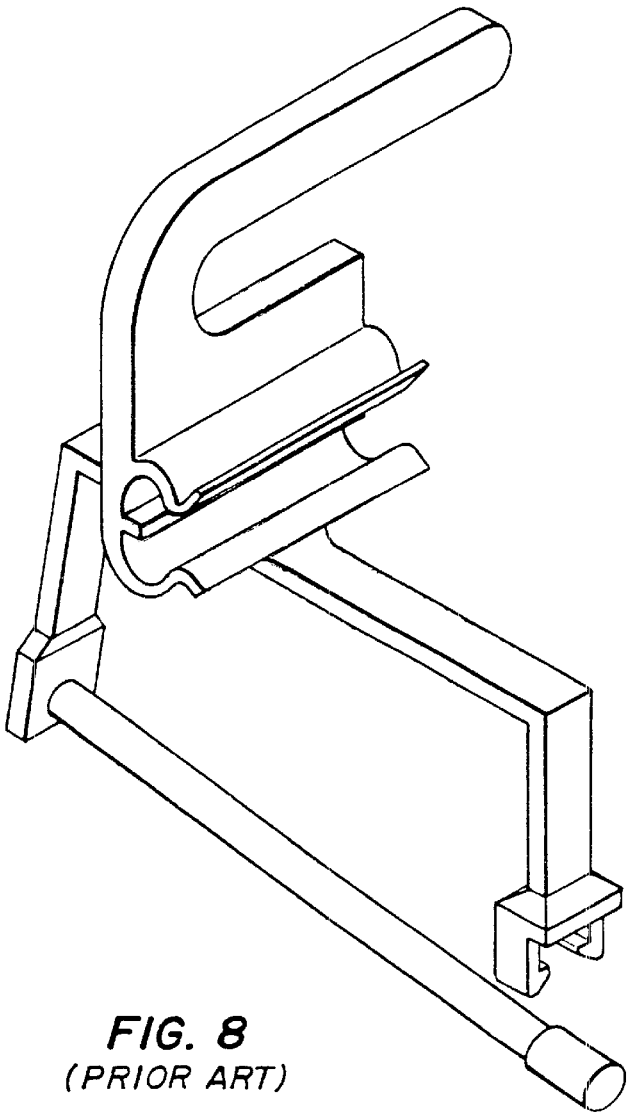
FIG. 8 (PRIOR ART)
FIG. 8 is a perspective view from above of a prior art carrier.

FIGS. 5–7 show a second embodiment of the invention. In this embodiment, ribs 40 extend outwardly from shaftholder base 31 along the length of shaftholder 17 and are parallel to inner sidewall 46 and each other. Third portion 29 and shoulder 24 meet at angled junction 49 with an angle of curvature θ. Base 12 has a planar portion 15 with side edges 16 curving from planar portion 15 to top 19 which is preferably planar. Side edges 16 can become part of outer When shaftholder 17 is empty, ear 42 and junction 49 restrict opening 44. Ear 42 projects from inner sidewall 46 toward outer sidewall 18 along the length of shaftholder 17. Ear 42 can touch outer sidewall 18.

Shaft 36 inserts into a shaftholder by pushing the shaft between shoulder 24 and inner sidewall 46. This slides the shaft down shoulder 24 and forces outer sidewall 18 to deflect laterally and opens restricted opening 44. Once past stop 42, shaft 36 locks into shaftholder 17 between sidewalls 18, 46. Rib 40 prevents shaft 36 from reaching shaftholder base 31 and helps position shaft 36 within the shaftholder, especially smaller shafts. Curved portions 26, 27, 29 of outer sidewall 18 are forced away from inner sidewall 46, thereby partially straightening curved portion outer sidewall 18. Junction 49 maintains its angle of curvature.

The spacing between inner and outer sidewalls allows the sidewalls to cooperatively hold shafts in position while resisting the free forward and backward movement of the shaft along the carrier when shifting the position of the carrier and shaft. The maximum distance between the maximum curvature of the outer sidewall and the inner sidewall is greater than or equal to the width of the largest shaft that can fit within the carrier, preferably greater than the width of the shaft. When carrying two shafts side by side in the carrier, this spacing between the outer and inner sidewalls tightens the sidewalls' hold on the shaft to prevent the shaft from slipping when shifting position from horizontal to vertical and back again. Yet, the player simply slides the carrier up or down the shaft to change the balance of the stick in the carrier.

Figure 3:
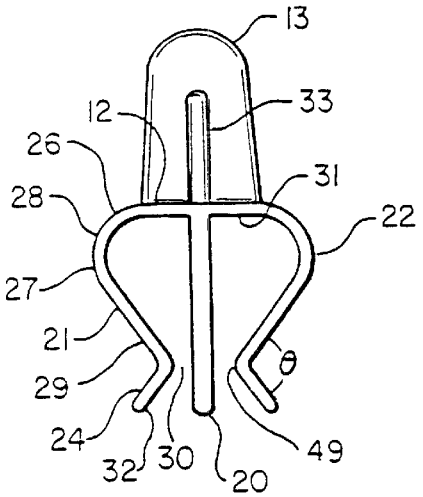
FIG. 3 is a side plan view of one embodiment of the carrier of the invention.

For the embodiment shown in FIGS. 3 and 4, the distance of the shoulder from the base is preferably greater than the height of the largest shaft. For example, if the height of the shaft is about 1.34 in., the distance of the shoulder from the base can be about 1.5 in. For the embodiment shown in FIGS. 5 and 6, the distance of the ear from the rib is preferably greater than the height of the largest shaft. For example, a shaftholder that is approximately 2.5 in. from the base to the edge of the shoulder has an ear approximately 1.5 in. and the rib about 0.025 in. from the base. The length of the shoulder from the angled junction to its tip is about 1 in.

A shaft inserted into the shaftholders at least partially contacts the adjacent faces of the cooperating sidewalls. Preferably the outer sidewall presses the shaft firmly against the inner sidewall. If the shaft is reasonably centered, it is supported on opposite sides of the center of gravity of the stick. This result is obtained notwithstanding an uneven finish to the faces of the sidewalls or to the shafts of the sticks. The sidewalls, particularly the outer sidewalls of the shaftholders, flex independently under the mechanical stress of introducing a shaft to allow each sidewall to make independent clean contact with the sticks.

The angled shoulders help guide the shaft into and out of the shaftholders. When inserting a hockey stick, for example, the player slides the stick toward the base. The angled shoulders guide the stick through the opening toward the base. When removing the stick, the force the player exerts on the stick enlarges the opening between the sidewalls as the sidewalls smoothly guide the shaft through the opening and out of the shaftholder.

Handle 13 extends from the top of the base 12. Handle 13 can have flanges 33 extending from base 12 to handle 13. Handle 13 is permanently attached to base 12. Finger grips can be added, if desired. Although two shaftholders are preferred, if desired, additional shaftholders can be added to the carrier, such as at the center of the base.

The shaftholder is made from material that is biased to return to its original shape. Although the sidewalls move when a shaft is inserted into the carrier, the material itself neither bends nor deforms around the shaft. The sidewalls, particularly the outer sidewall and the base may act as a spring clamping a shaft into a shaftholder. When the shaft is removed, the sidewalls regain their initial position. Suitable materials have high strength (tensile, flexural, compressive and shear) with good toughness or impact strength. Preferably, the material has a stiffness or tensile or flexural modulus greater than about 700 MPa or 100,000 psi at 23° and 50% relative humidity. Plastics, with or without fillers, such as polyamide like nylon 6 and nylon 6/6, polypropylene, and the like are suitable.

Although the base and/or handle could be made of a lightweight metal with plastic shaftholders, the whole carrier is preferably made from plastic. The base, sidewalls and handle can be made separately and affixed together by any known method, such as gluing or annealing.

Although the Figures show the invention with ice hockey sticks, the carrier of the invention can hold other long shafted equipment for other sports such as street hockey, field hockey, broom ball, lacrosse, and the like. The second embodiment surprisingly holds rounded shafts well.

The carrier of the invention allows a player to easily place long shafted items, such as hockey sticks into the carrier. While holding a stick with one hand, a hockey player, for example, angles the shaftholder or the shaft at one end of the carrier and slides the shaft over the shoulder between the outer and inner sidewalls. The shaftholder at the opposite end of the carrier readily slides into place over the shaft.

The player removes the shaft from the carrier by holding the shaft in one hand and pulling the handle of the carrier away from the shaft until it releases. The carrier of the invention allows the player to simultaneously remove both sticks at the same time by holding the sticks in one hand and pulling the handle away from the sticks with the other.

The ease of insertion and removal with the carrier of the invention has additional advantages. The player need not manually force the sidewalls apart to insert or remove a stick, which makes the carrier easier to use, especially when hands are sweaty or cold and stiff or gloved.

If the weight of the shaft is not evenly distributed, the player can slide the carrier along the shaft to redistribute the weight and reduce wrist fatigue. Yet, the player can vertically tip the carrier of the invention to pass through narrow passageways and doorways without the shaft slipping in the carrier.

The curved design of the shaftholder allows one carrier to be used with different sizes and types of shafted sports equipment. The curved design and opening allows equipment with narrow and wide shafts to use the same carrier. This reduces the need for multiple molds to make a variety of carrier sizes. Inventory expenses are also reduced because fewer carriers are needed to be made and stored.

While the invention is shown in only one of its forms, it is not thus limited but is susceptible to various changes and modifications without departing from the spirit and scope of the invention.

What is claimed is:

1. A carrier for sports equipment with a shaft comprising:

a base having opposite ends;

first and second shaftholders at opposite ends of the base on a face thereof and aligned to jointly engage the shaft;

each shaftholder having a pair of outer sidewalls curving proximally from the base, each outer sidewall having an outwardly angled shoulder extending along the length of the outer sidewall distal to the base, a first portion of the outer sidewall curving outwardly away from the base, and a second portion of the outer sidewall curving inwardly from the first portion;

an inner sidewall located between the pair of outer sidewalls;

ears projecting from opposite sides of the inner sidewall toward the outer sidewalls and extending along the length of the shaftholder;

a handle depending from the base and extending from a second face of the carrier opposite the face from which the shaftholders extend; and ribs depending from the base along the length of the shaftholder and located between the outer and inner sidewalls.

2. A carrier of claim 1, wherein the outer sidewalls have a third portion located between the second portion and the shoulder.

3. A carrier of claim 2, further comprising:

a restricted opening between the inner sidewall and the shoulder.

4. A carrier of claim 3, wherein the sidewalls and the base act as a spring to clamp the shaft into the shaftholder.

* * * * *